United States Patent [19]

Francis

[11] Patent Number: 4,792,722

[45] Date of Patent: Dec. 20, 1988

[54] CATHODE RAY TUBE HAVING A FLAT FACEPLATE ATTACHED BY A COMPLIANT PRESSURE BONDED SEAL

[75] Inventor: Leslie H. Francis, Horley, England

[73] Assignee: U.S. Philips Corporation, New York, N.Y.

[21] Appl. No.: 14,512

[22] Filed: Feb. 13, 1987

[30] Foreign Application Priority Data

Feb. 21, 1986 [GB] United Kingdom ..... 8604321

[51] Int. Cl.[4] ..... H01J 29/86

[52] U.S. Cl. ..... 313/477 R; 313/482; 220/2.3 A

[58] Field of Search ..... 313/422, 477 R, 482; 220/2.1 A, 2.3 A

[56] References Cited

U.S. PATENT DOCUMENTS 4,325,489 4/1982 Russell et al. ..... 313/422 X

*Primary Examiner*—David K. Moore
*Assistant Examiner*—K. Wieder
*Attorney, Agent, or Firm*—Norman N. Spain

[57] ABSTRACT

A cathode ray tube has an envelope comprising a mild steel rear housing (1) with a side wall portion (4) defining an opening over which a flat, glass, faceplate (2) is mounted. The faceplate is sealed in a vacuum tight manner using a compliant pressure bonded seal (10), comprising pressure deformable material such as lead, to the outer, flat surface of a flange (8) of the rear housing which projects inwardly of the opening from the side wall portion.

5 Claims, 1 Drawing Sheet

CATHODE RAY TUBE HAVING A FLAT FACEPLATE ATTACHED BY A COMPLIANT PRESSURE BONDED SEAL

BACKGROUND OF THE INVENTION

This invention relates to a cathode ray tube having an envelope comprising a metal rear housing having a wall portion defining an opening and a substantially flat glass faceplate which extends over the opening and is sealed in a vacuum-tight manner to the surface of a flange on the rear housing extending around the opening by means of a compliant pressure bonded seal between the faceplate and the flange and comprising a pressure deformable material.

The rear housing, which in the finished cathode-ray tube contains the electron gun and other components of the tube, is usually referred to as the cone portion of the envelope, although it may not be strictly, or even remotely, conical in the geometric sense. For example, a new type of rear housing which is very relevant to the present invention and which may be referred to as a "flat-can" rear housing has the form of a shallow rectangular, metal can with a generally flat, slightly dished bottom and an open top surrounded by a flange. An envelope having this type of rear housing is used in so-called flat cathode-ray tubes. To form the envelope a rectangular flat glass faceplate is sealed to the flange of the can.

In order to reduce costs, it is advantageous to make the envelope using cheap components which can be sealed using simple apparatus and at relatively low temperatures. Thus the metal rear housing may consist of mild steel for cheapness and ease of forming. The faceplate may consist of flat toughened float glass which is significantly cheaper than conventional moulded glass faceplates and need not be so thick so that it is lighter. Such materials are not ideally matched as regards their coefficients of thermal expansion but by using a compliant pressure bonded seal to bond the faceplate and metal rear housing together and provide a seal therebetween, the effects of the difference in the coefficients of thermal expansion can be accommodated. Examples of compliant, pressure bonded seals are given in Applicant's British Patent Specification No. 1598888, corresponding to U.S. Pat. No. 4,268,712 whose disclosure in this respect is incorporated herein by reference. Whilst the bonding achieved by such seals might not be as stiff as that provided by a glass frit seal, the latter form of seal is comparatively brittle and not suited to bonding together materials having significantly differigg coefficients of thermal expansion. Moreover, glass frit seals require the application of considerably higher temperatures when forming the seal which, besides being more expensive to implement, can be undesirable as regards the risk of possible damage to components within the envelope.

British Patent Specification No. 2123210 describes a cathode ray tube envelope having a construction as defined in the opening paragraph. In the described construction, the peripheral portion of the flat glass faceplate overlies the flange of the rear housing and this flange projects outwardly from the opening defined by the rear housing.

In the manufacture of a cathode-ray tube having an envelope of this construction the faceplate deflects inwards slightly upon evacuation of the envelope and there is a consequent tendency for the faceplate to peel away from the seal between the faceplate and the flange of the rear housing and/or for the seal to peel away from the flange.

To counteract this tendency, it is proposed in the aforementioned British Patent Application No. 2123210 that spring clamps be provided on the edges of the faceplate and flange, each such clamp consisting of, for example, a spring stee channel member with wall portions which converge towards one another and which engage with the front and rear surfaces of the faceplate and flange respectively to exert a clamping force perpendicular to these surfaces to hold the faceplate and flange together. While being effective, the provision of these clamps complicates the construction of the cathode ray tube envelope and adds to the overall cost of the cathode ray tube.

SUMMARY OF THE INVENTION

It is an object of the present invention to provide a cathode ray tube having an envelope of the kind described in the opening paragraph which employs a compliant pressure bonded seal enabling certain materials having different thermal expansion coefficients to be employed but which avoids the need for additional components as described in the aforementioned British Patent Specification No. 2123210 and which therefore is cheaper and simpler to produce.

According to the present invention, there is provided a cathode ray tube having an envelope comprising a metal rear housing having a wall portion defining an opening and a substantially flat glass faceplate which extends over the opening and is sealed in a vacuum-tight manner to the surface of a flange on the rear housing extending around the opening by means of a compliant pressure bonded seal between the faceplate and the flange and comprising a pressure deformable material, which is characterised in that the flange of the rear housing projects inwardly of the opening.

By arranging that the flange projects inwardly of the opening in accordance with the invention rather than outwardly as in the earlier form of construction, it has been found that the need to provide clamping elements for clamping the flange and peripheral portion of the faceplate together is avoided. It is believed that in the earlier form of construction, inwards deflection of the faceplate upon evacuation of the envelope causes separation of the peripheral portion of the faceplate and the flange as a result of the faceplate pivotting about the inner end of the flange where it joins the side wall of the rear housing adjacent the opening, this region acting as a fixed pivot edge. When the faceplate pivots around that edge, its peripheral portion is pulled away from the flange putting the seal area into tension. The invention on the other hand does not suffer from this problem as the seal is located inwardly of the region where the flange joins the side wall portion of the rear housing and the peripheral portion of the faceplate and the opposing surface of the flange remain in compression upon deflection of the faceplate inwardly of the envelope as the flange itself is able to deflect slightly about the transition region where it joins the side wall portion of the rear housing to accommodate the small deflection of the faceplate. This deflection of the flange tends to assist in maintaining the compressive forces on the seal itself. Thus the invention provides a simple form of sealing bond between the housing and the faceplate which, by virtue of the compliant nature of the seal, enables the advantageous use of a mild steel rear housing and a toughened glass faceplate as in the earlier tube but without the additional cost and complexity of manufacture involved with the provision of clamping elements.

Although in order to maintain the same screen area it may be necessary to increase overall the dimensions of the rear housing because of the inwardly projecting flange, this can in fact be beneficial as there is then more room available within the envelope for accommodating electrical interconnection wires for the internal components of the tube which and as a result assembly is facilitated. This is particularly important in the case of, for example, a generally flat cathode ray tube such as described in British Patent Specification No. 2101396 using a channel plate electron multiplier and electrostatic deflection electrodes and demanding a comparatively large number of connection wires.

DETAILED DESCRIPTION OF THE INVENTION

Figure 1:
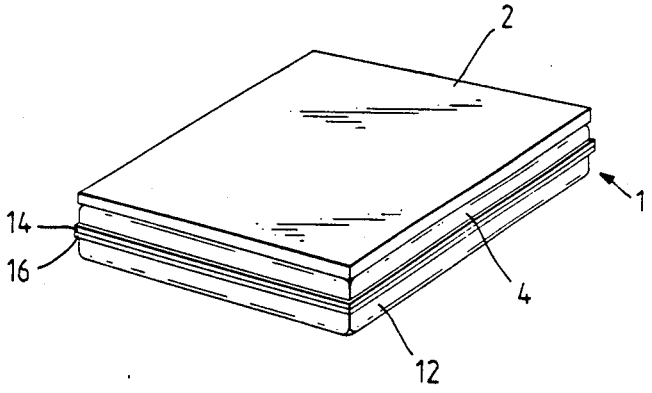
FIG. 1 is a perspective view of a cathode-ray tube of the invention and FIG. 2 is a sectional, perspective view, drawn to an enlarged scale of a portion of the cathode ray tube of FIG. 1 showing the faceplate bonded in a vacuum-tight manner to the flange of the rear housing of the envelope.

The invention will now be described in greater detail.

In an advantageous embodiment the peripheral portion of the faceplate extends at least as far as the transitional region between the flange and the wall portion of the rear housing. This enables the seal to be located close to the side wall of the rear housing so that the support of the faceplate is concentrated adjacent the side wall and the compressive force acting between the faceplate and rear housing is mainly directed through that side wall. Preferably, the seal extends outwardly of the flange at least as far as adjacent the transitional region between the flange and the wall portion. In this way, the compressive force is caused to act as close as possible to the side wall.

The rear housing may be in the form of a shallow, rectangular, generally flat-bottomed metal can with an open top bordered by the flange and whose side wall portion defines the opening and meets the faceplate at approximately ninety degrees with respect to the plane of the faceplate. Alternatively, the rear housing may be of the more conventional conical form with a side wall portion meeting the faceplate at an angle less than ninety degrees.

The rear housing may be formed of two parts, the first part comprising the wall portion and the flange and the second part closing the envelope and being joined to the first part in a vacuum-tight manner. In this way assembly of the envelope can be greatly facilitated. The first part is bonded to the faceplate prior to the two parts of the housing being joined together so that access can be gained to the underside of the flange to support the flange during the bonding operation. Thereafter, the internal components of the tube are installed and the second part of the rear housing joined to the first part around peripheral mating lips, for example by laser welding, to complete the tube. In the case of the rear housing comprising a shallow rectangular, generally flat-bottomed, can, the first part consists of the flange and a generally rectangular side wall portion and the second part consists of the bottom and integral upstanding walls constituting the lower sections of the side wall of the housing. The lower side wall sections terminate in a lip which mates with a peripheral lip provided at the lower end of the side wall portion of the first part.

An embodiment of the invention will now be described, by way of example, with reference to the accompanying drawing:

As shown in the figures of the drawing the cathode ray tube has an envelope comprising a rectangular flat-can mild steel rear housing 1 and a substantially flat faceplate 2 of toughened float glass having dimensions of around 300 mm by 270 mm. The mild steel of the rear housing and the faceplate have thicknesses of around 1 mm and 6 mm respectively. The rear housing 1 is formed for example by deep drawing from mild steel sheet and has a rectangular, straight-edged, side wall portion 4 which meets the faceplate 2 at approximately ninety degrees with respect to the plane of the faceplate and defines a rectangular opening 6 over which the faceplate lies. Only a small part of the side wall portion 4 of the rear housing, the faceplate 2 and the opening 6 are visible in FIG. 2. The generally flat bottom of the rear housing is dished slightly inwards.

Figure 2:
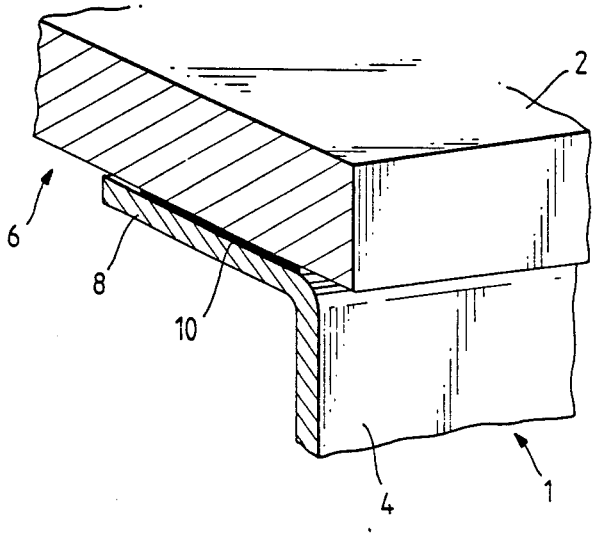

Referring particularly to FIG. 2, the rear housing 1 is rrovided with a continuous, flat-surfaced integral flange 8 at right angles to the side wall portion 4 which projects inwardly of the opening 6 at right angles to the side wall portion 4 and substantially parallel to the plane of the faceplate 2 completely therearound. The flange 8 has a width of approximately 2 cms. The faceplate 2 is dimensioned so that its peripheral edge, comprising straight sections, extends slightly outwardly of the corner transitional region of the rear housing where the flange 8 joins the side wall portion 4.

The glass faceplate 2 is sealed in a vacuum-tight manner to the flange 8 by means of a compliant pressure-bonded seal 10 consisting of a pressure deformable material, for example, lead. The seal 10 extends completely around the flange 8 and, as shown in FIG. 2, outwardly of the flange to the transitional region between the flange 8 and the side wall portion 4 so that support of the faceplate 2 is concentrated adjacent the side wall portion 4 with the compressive force acting through the seal 10 being mainly directed through the side wall portion.

The pressure bonding of the seal 10 may be carried out by thermo-compression method, for example, a method similar to that described in the Applicant's aforementioned British Patent Specification No. 1,598,888 whose disclosure in this respect is incorporated herein by reference. Briefly, the faceplate 2 and the flange 8 are placed in a press with a length of 2.5 mm diameter 99.99% pure lead wire disposed between the flange 8 and the peripheral portion of the faceplate in the form of a loop with adjoining ends. The faceplate, flange and lead wire are heated so that the temperature in the bonding zone is around 290° C. A load of around 790 kg. is then applied between the flange 8 and peripheral portion of the faceplate resulting in partial flattening of the lead wire to form a vacuum-tight seal between the flange and the faceplate and between the ends of the wire. The heating is then stopped and the load progressively reduced to zero by the time the temperature of the bonding zone drops to 250° C. The assembly comprising the faceplate bonded to the flange is then allowed to cool. In this method, the rear housing may be in one piece with the tubes electron optical components installed, and a screen provided on the faceplate, prior to the pressing operation.

In another method, however, and as shown in FIG. 1, the rear housing 1 is formed in two parts, an upper part comprising the generally rectangular side wall portion 4 and flange 8 and a lower part 12 comprising a lower side wall portion to be mated with the side wall portion 4 and a generally flat base. With this arrangement, the upper part of the rear housing is bonded to, and sealed with, the faceplate in the above-described manner. Thereafter the internal components are installed and the lower part 12 of the rear housing joined to the upper part 4 around respective peripheral mating lip edges 14 and 16 by laser welding so as to form a vacuum-tight, and rigid, joint.

This arrangement has the advantage that ready access is permitted to the lower, i.e. innermost, surface of the flange 8 so that support can be applied to the flange during the load-applying operation.

Upon evacuation of the envelope, via a suitable, sealable, pump stem attached to the rear housing, the faceplate 2 is deformed inwardly of the envelope slightly under the influence of ambient atmospheric pressure. This deformation can result in the center of the faceplate being deflected downwardly into the envelope by around 1 mm. The inwardly-projecting flange 8, however, is able to accommodate this deflection and bends downwardly around the region where the flange 8 joins the side wall portion 4 so as to conform with the deformation to the faceplate 2. In this way, compression between the flange 8 and the peripheral portion of the faceplate 2 is maintained, with the deflection of the flange 8 tending to increase the compressive force within the seal, thus ensuring that the bonding seal betwenn those parts does not suffer any tensile effects.

Evacuation of the envelope and subsequent inward deflection of the faceplate also results in slight relative movement between the faceplate 8 and the flange in directions parallel to the planes of their adjacent surfaces. These slight relative movements are accommodated by the compliant nature of the pressure bond seal 10.

Although the use of lead as the pressure-deformable material constituting the compliant pressure-bonded seal has been described specifically, other suitable materials may be used instead, for example malleable metals such as copper, silver, aluminum or gold as described in the British Patent Specification No. 1598888.

Furthermore, although the particular embodiment of the tube described has a rectangular faceplate and rear housing, the invention is applicable also to tubes having faceplates and rear housings of different shape. For example, the faceplate and at least the side wall portion of the rear housing adjacent the faceplate may be circular. Alternatively, the faceplate may be of more conventional form being generally rectangular with edges of slightly convex curvature.

I claim:

1. A cathode ray tube having an envelope comprising a metal rear housing having a wall portion defining an opening and a substantially flat glass faceplate which extends over the opening and is sealed in a vacuum-tight manner to the surface of a flange on the rear housing extending around the opening by means of a compliant pressure bonded seal between the faceplate and the flange and comprising a pressure deformable material, characterised in that the flange of the rear housing projects inwardly of the opening and has an edge within said opening.

2. A cathode ray tube according claim 1, characterised in that the peripheral portion of the faceplate extends at least as far as the region where the flange and the wall portion of the rear housing meet.

3. A cathode ray tube according to claim 2, characterised in that the seal extends outwardly of the flange at least as far as adjacent the region where the flange and the wall portion of the rear housing meet.

4. A cathode ray tube according to claim 1, characterised in that the width of the flange is such that it can be deflected to conform to the deformation of the faceplate under the influence of ambient atmospheric pressure.

5. A cathode ray tube according to any one of claim 1, characterised in that the rear housing is formed of two parts, a first part comprising the wall portion and the flange and a second part closing the envelope and being joined to the first part in a vacuum-tight manner.

* * * * *